US005410391A

United States Patent [19]

Imabayashi et al.

[11] Patent Number: 5,410,391

[45] Date of Patent: Apr. 25, 1995

[54] IMAGE-TRANSFER APPARATUS WITH MOVABLE SMOOTHING ROLLER AND IMAGE-TRANSFER METHOD

[75] Inventors: Arata Imabayashi; Takayuki Kimura; Isao Hosoi, all of Tokyo, Japan

[73] Assignee: Toyo Ink Manufacturing Co., Ltd., Tokyo, Japan

[21] Appl. No.: 50,645

[22] Filed: Apr. 22, 1993

[51] Int. Cl.[6] ..... G03G 15/14; G03G 21/00

[52] U.S. Cl. ..... 355/271

[58] Field of Search ..... 355/212, 213, 271, 274, 355/277

[56] References Cited

U.S. PATENT DOCUMENTS

| | | | |
|---|---|---|---|
| 3,839,961 | 10/1974 | Murata | 355/213 X |
| 3,903,795 | 9/1975 | Suzuki | 355/213 X |
| 3,995,951 | 12/1976 | Hawkins et al. | 355/213 |
| 4,219,272 | 8/1980 | Bruckel et al. | 355/213 |
| 4,277,164 | 7/1981 | Fortmann | 355/213 |
| 4,605,298 | 8/1986 | Russel et al. | 355/271 |
| 4,864,358 | 9/1989 | Kasahara | 355/277 |
| 5,021,829 | 6/1991 | Johnson et al. | 355/277 X |
| 5,081,501 | 1/1992 | Waki et al. | 355/277 X |
| 5,084,736 | 1/1992 | Suzuki et al. | 355/271 |
| 5,142,305 | 8/1992 | Maslanka et al. | 355/213 X |
| 5,168,290 | 12/1992 | Tanaka et al. | 355/271 X |

*Primary Examiner*—Fred L. Braun

*Attorney, Agent, or Firm*—Wenderoth, Lind & Ponack

[57] ABSTRACT

An image-transfer apparatus equipped with a smoothing device (roller), which device, when an image-forming material is attached to a platen, prevents the formation of a crinkle in the image-forming material thereby to remove a deviation in registering (positioning) the image-forming material, and an image-transfer method using the above imge-transfer apparatus.

8 Claims, 4 Drawing Sheets

IMAGE-TRANSFER APPARATUS WITH MOVABLE SMOOTHING ROLLER AND IMAGE-TRANSFER METHOD

FIELD OF THE INVENTION

The present invention relates to an image-transfer apparatus and an image-transfer method. More specifically, it relates to an image-transfer apparatus equipped with a device for attaching an image-forming material, which device, when the image-forming material is attached to a platen, prevents the formation of a crinkle in the image-forming material thereby to remove a deviation in registering (positioning) the image-forming material, and a method of image transfer.

PRIOR ART

In recent years, a single-color or multi-color prepress proof is increasingly prepared for proof printing, and the prepress proof is produced by preparing an image-forming material formed of a substrate and a photosensitive layer coated on one surface of the substrate, exposing the photosensitive layer to form an image, and transferring the image to an image receptor such as paper generally under heat.

When an image of, for example, four colors is formed on an image receptor such as paper, images formed on the photosensitive layers are individually transferred to one image receptor by individually bringing the photosensitive layers forming the images into contact with the image receptor under pressure. When a crinkle occurs in any image-forming material in attaching the image-forming material to the platen, the registering of images deviates, and no proper printed image suitable for proof printing can be obtained. Further, the image transfer is facilitated by heating the image receptor beforehand, and as a result, a proper printed image can be obtained. Therefore, the platen has a heating means within it.

The image-forming material used in the present invention comprises a substrate, a photosensitive layer formed on one surface of the substrate and a protection layer. As the substrate and protection layer, there are used thin films or sheets formed of any one of the materials such as cellulose acetate, polystyrene, polyvinyl chloride and polyethylene terephthalate. Since the substrate and protection layer are formed of such soft material(s), the image-forming material is characteristically liable to crinkle or slacken when attached to the platen.

As the apparatus for producing the above prepress proof, there has been proposed an apparatus for forming a transfer image on an image receptor, generally, by attaching image-forming material(s) to a platen, attaching an image receptor to a transfer cylinder, and bringing the platen and the transfer cylinder into contact under pressure to transfer image(s) formed in the photosensitive layer(s) to the image receptor in a nip portion formed by the platen and the transfer cylinder. It has been strongly desired to develop a device and a method for easily attaching a soft, sheet-like material to the outer surface of a cylinder to be rotated such as a platen and a transfer cylinder without causing a crinkle and slackening but with accuracy in registering. No satisfactory device has yet been developed.

SUMMARY OF THE INVENTION

It is an object of the present invention to provide an apparatus and a method for transfer an image for producing a prepress proof, in which a soft, sheet-like material such as an image-forming material can be attached with a simple means without causing a crinkle and slackening and further the soft, sheet-like material can be easily attached and easily detached.

According to the present invention, there is provided an image-transfer apparatus which comprises a platen to which an image-forming material is to be attached and a transfer cylinder to which an image receptor is to be attached, and which allows the transfer of an image formed in a photosensitive layer of the image-forming material to the image receptor between a nip formed by the platen and the transfer cylinder, the apparatus being equipped with a smoothing roller for tightly attaching the image-forming material to the surface of the platen, the smoothing roller having a roller shaft extending from both sides of the smoothing roller and a swing arm having a shaft-movable hole through which the roller shaft is positioned, the swing arm being fitted on a swing arm shaft which is placed in a position decentered from the center of the platen and which is supported by frames of the apparatus, the smoothing roller being arranged to be drawn to the surface side of the platen through an elastic member positioned between the roller shaft and the swing arm, the smoothing roller being adapted to shift its position between a position in contact with the platen surface and a position out of contact with the platen surface due to the rotation of the swing arm.

Further, according to the present invention, there is provided a method of transferring an image formed in a photosensitive layer of an image-forming material to an image receptor by introducing the image-forming material into a nip formed by a platen and a transfer cylinder by means of an image-transfer apparatus which has a platen to which the image-forming material is to be attached, a transfer cylinder to which the image receptor is to be attached, means of attaching the image-forming material for holding the top end and the bottom end of the image-forming material on the surface of the platen entirely in the width direction of the image-forming material, means of attaching the image receptor for holding the top end and bottom end of the image receptor on the transfer cylinder entirely in the width direction of the image receptor, a tray for introducing the image-forming material in which the image-forming material is to be placed, a tray for introducing the image receptor in which the image receptor is to be placed, and a smoothing roller for tightly attaching the image-forming material to the surface of the platen, wherein the means of attaching the image-forming material for holding the top end of the image-forming material is formed of a sheet receiving portion positioned in a partially cut-out portion formed on the surface of the platen and an adhesive tape for holding the image-forming material between the sheet receiving portion and that surface of the platen which is located near the cut-out portion, and the means of attaching the image-forming material for holding the bottom end of the image-forming material is formed of an adhesive tape provided on the surface of the platen, the method comprising tilting the tray for introducing the image-forming material in which the image-forming material is placed, to position the top portion of the tray between the sheet receiving portion and the adhesive tape located on the surface of the platen near to the sheet receiving portion, thereby placing the image-forming material in the sheet receiving portion, bringing the smoothing roller into contact with the image-forming material between the sheet receiving portion and the top portion of the tray, and rotating the platen to tightly attach the image-forming material to the surface of the platen, thereby allowing the adhesive tapes to hold the top end and bottom end of the image-forming material.

DETAILED DESCRIPTION OF THE INVENTION

The present invention will be explained hereinafter by reference to drawings.

Figure 1:
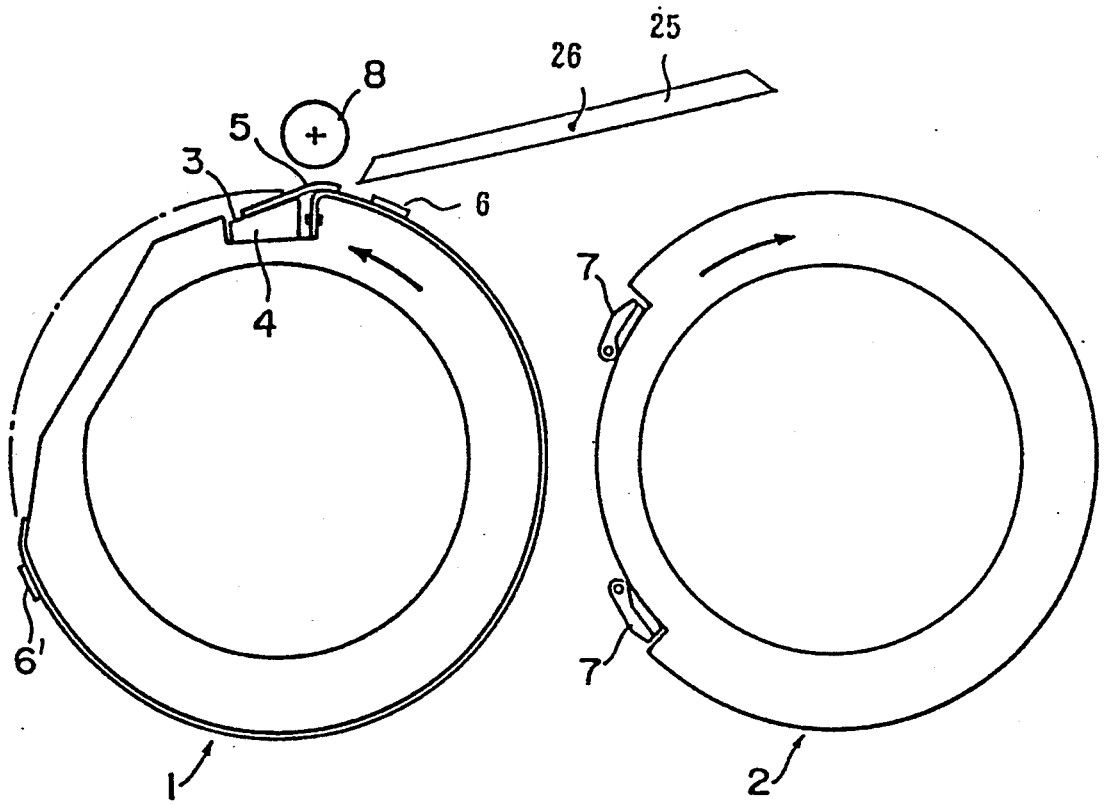
FIG. 1 is a schematic view showing an image-transfer apparatus equipped with a movable smoothing roller, provided by the present invention.

FIG. 1 schematically shows one embodiment of the image-transfer apparatus equipped with a movable smoothing roller, provided by the present invention. Numeral 1 indicates a platen and numeral 2 indicates a transfer cylinder. An image-forming material (not shown) is attached to the platen, and an image receptor (not shown) is attached to the transfer cylinder. The platen and the transfer cylinder are allowed to rotate in the directions indicated by arrows, and an image, which has been already formed in a photosensitive layer of the image-forming material by exposure, is transferred to the image receptor by bringing the image into contact with the image receptor under pressure in a nip formed by the platen and the transfer cylinder. Numeral 3 indicates a partially cut-out portion, numeral 4 indicates a sheet receiving bed formed in the partially cut-out portion 3, numeral 5 indicates a magnet sheet, numeral 6 indicates an adhesive tape (for holding the top end side of the image-forming material), and numeral 6' indicates an adhesive tape (for holding the bottom end side of the image-forming material). The top end side of the image-forming material is placed between the sheet receiving bed 4 and the magnet sheet 5, and then the platen 1 is rotated to attach the top end side of the image-forming material to the adhesive tape 6 and attach the bottom end side of the image-forming material to the adhesive tape 6'. The sheet receiving bed 4 may have a pin bar having at least one pin (29, 30 in FIG. 4) in the direction of the shaft for the platen 1. When the pin bar is provided, hole(s) is/are made in the top end side of the image-forming material so that the pin(s) are placed in the hole(s), whereby the registering of the image-forming material can be accurately achieved. When the pin bar is provided, the magnet sheet is not always necessary, while the magnet sheet serves to secure the fixing of the image-forming material to the surface of the platen. In this case, hole(s) is/are made in the magnet sheet so that the pin(s) are placed in the hole(s).

Numeral 7 indicates a clamp. The image receptor material is attached to the transfer cylinder 2 with the clamp 7. The means of attaching the image-forming material and the means of attaching the image receptor may be freely selected from conventional means. Since the image-forming material is formed of a soft material, a crinkle, slackening, etc., are liable to occur after its top end side is attached and when its bottom end side is attached. Numeral 8 indicates a smoothing roller. For preventing such a crinkle and slackening, it is superior to employ a method in which, after the top end side of the image-forming material is attached, then the platen 1 is allowed to rotate while the image-forming material is tightly in contact with the platen surface by means of the smoothing roller 8, and then the bottom end side of the image-forming material is attached to the platen. The smoothing roller 8 employed in the present invention is a movable smoothing roller which is easy to handle and excellent in smoothing effect. The smoothing roller is preferably formed from a heat-resistant resin such as a silicone rubber, and it preferably has a proper frictional force against the image-forming material.

Figure 2:
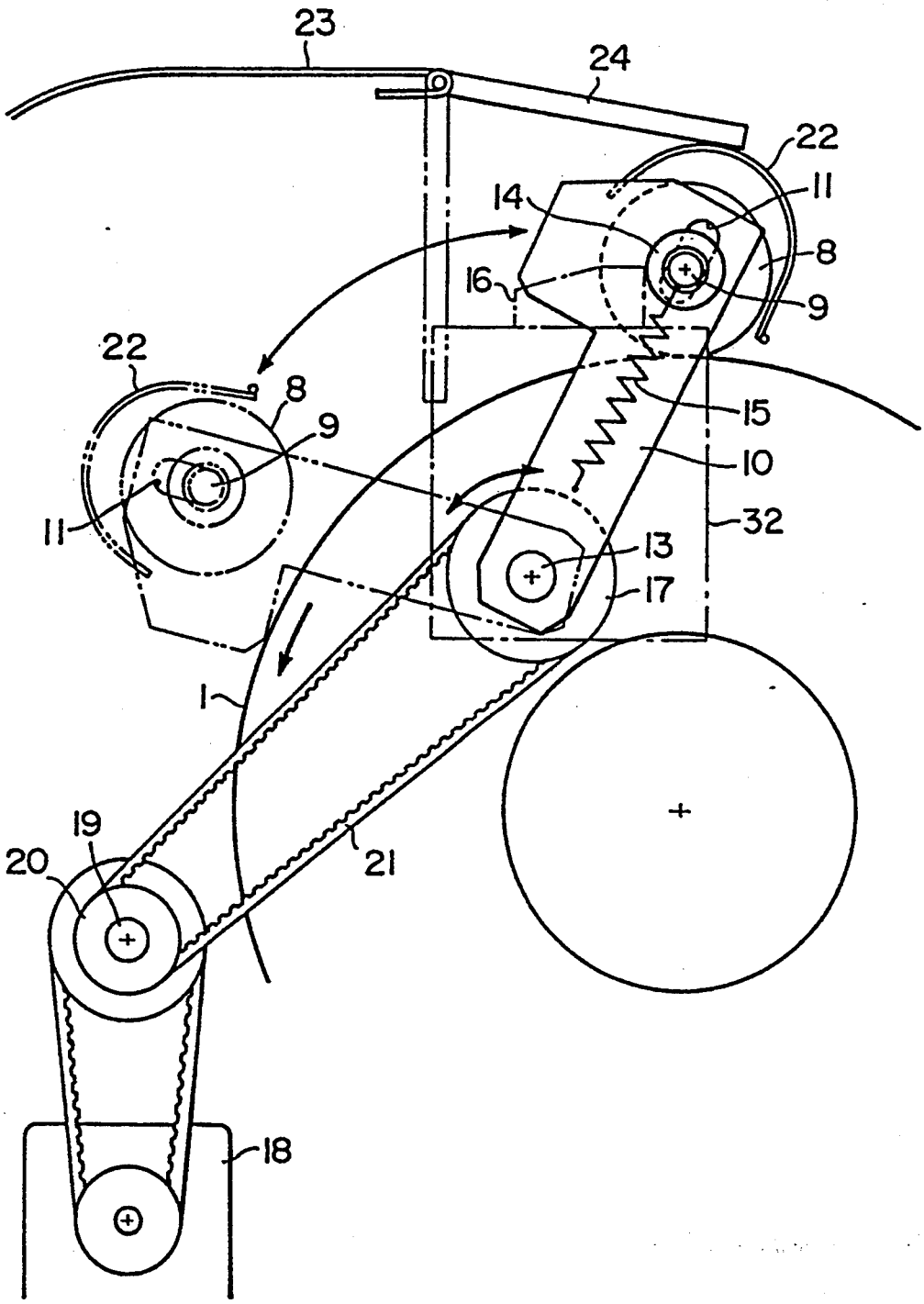
FIG. 2 is a partial cross-sectional view showing a specific constitution of the smoothing roller used in the present invention.

FIG. 2 is a partial cross-sectional view showing the specific constitution of the smoothing roller used in the present invention.

Figure 3:
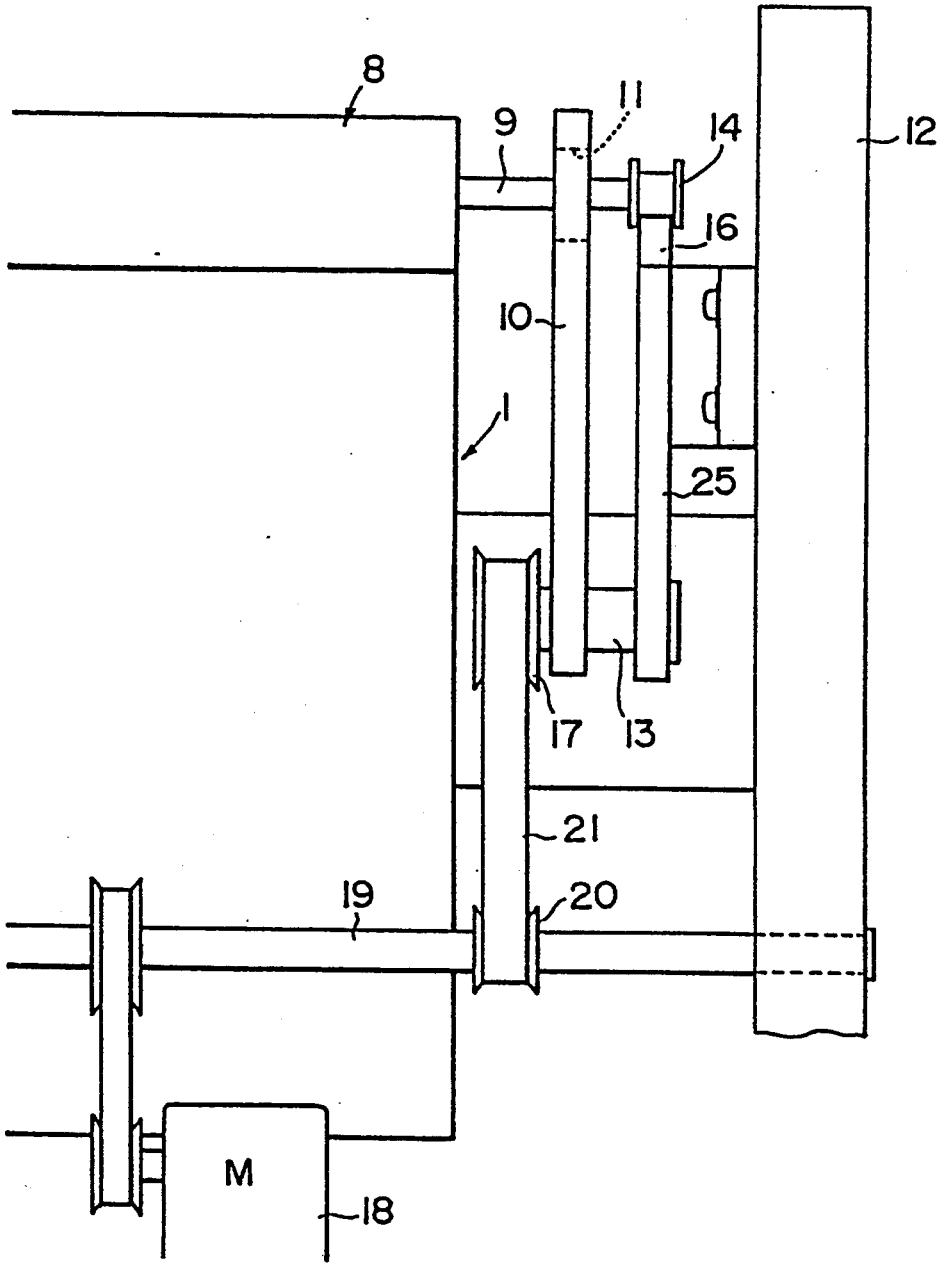
FIG. 3 is a partial front view showing an image-transfer apparatus having a smoothing roller, provided by the present invention.

FIG. 3 is a partial front view showing an image-transfer apparatus equipped with the smoothing roller, provided by the present invention.

Numeral 9 indicates a roller shaft, numeral 10 indicates a swing arm (a swing arm on the back side of the platen is not shown), and numeral 11 indicates a shaft-movable hole (generally formed in the shape of a rectangle, etc.). The roller shaft 9 extending from the side of the smoothing roller 8 is placed through the shaft-movable hole 11 provided in one end portion of the swing arm 10. Numeral 12 indicates a frame (a frame on the back side of the apparatus is not shown), and numeral 13 indicates a swing arm shaft. The other end of the swing arm 10 is supported on the swing arm shaft 13. The swing arm shaft 13 is positioned in a place decentered from the central axis of the platen 1 and is fit on a guide rail support member 32 mounted on the frame 12. Due to the rotation of the swing arm shaft 13, the smoothing roller 8 can shift its position between a position in contact with the platen surface and a position out of contact with the platen surface. A dotted line in FIG. 2 shows the smoothing roller 8 in a position out of contact with the platen surface. Numeral 15 is an elastic member. One end of the elastic member 15 is fixed to the swing arm 10, and the other end of the elastic member 15 is fixed to the roller shaft 9 of the roller 8. The contact pressure between the smoothing roller 8 and the platen surface is adjusted by the elastic member 15.

Numeral 14 is a guide roller, and numeral 16 is a guide rail. Guide roller 14 is attached to the end portion of the roller shaft 9. The guide rail 16 is arranged so that it contacts the guide roller 14 when the smoothing roller 8 is in a position in contact with the platen surface. When the smoothing roller 8 contacts the platen surface and rotates, the guide rail 16 prevents the smoothing roller 8 from moving together with the rotation of the platen.

The swing arm 10 is manually and electrically rotatable. FIGS. 2 and 3 show the swing arm which is electrically rotatable. Numeral 17 indicates a pulley, numeral 18 indicates a motor, numeral 19 indicates a swing arm operation shaft, numeral 20 indicates a pulley, and numeral 21 indicates a belt. The pulley 17 is attached to the swing arm shaft 13. The swing arm operation shaft 19 is actuated with the motor 18, and the pulley 20 is attached to the swing arm operation shaft 19. The pulley 17 and the pulley 20 are connected with the belt 21. The swing arm operation shaft 19 is supported on the two frames 12, and when the swing arm operation shaft 19 is actuated, the swing arm 10 on the front side and the swing arm 10 on the back side can be operated simultaneously.

In FIG. 2, numeral 22 indicates a cover, numeral 23 indicates an apparatus cover, and numeral 24 indicates a movable cover. The movable cover 24 is located in the end portion of the apparatus cover 23. It is preferred in terms of safety to open and close the movable cover 24 by the rotation of the cover 22 which is synchronized with the rotation of the swing arm 10.

In FIG. 1, the adhesive tape 6 is preferably an adhesive double coated tape and is located below a tray 25 but on the platen surface in the direction of a shaft for the platen. Further, the adhesive tape 6' is also located on the surface of the platen for holding the bottom end side of the image-forming material. For preventing the damage of the clamp 7 provided on the transfer cylinder 2 or the platen surface, it is preferred to form a cut portion (as shown by numeral 28) which is at a lower level than the level of the partially cut-out portion of the platen 1.

The tray 25 is movable/tiltable with its fulcrum 26 as a center, and for placing the image-forming material on the sheet receiving bed 4, the top end side of the tray 25 is tilted toward the platen. After the top end side of the image-forming material (not shown) placed on the tray 25 is positioned in place on the sheet receiving bed 4, the smoothing roller 8 is moved toward the platen side between the cut-out portion 3 and the top end portion of the tray 25, and the image-forming material is tightly attached to the platen surface with the smoother roller 8. When the magnet sheet 5 is used, the image-forming material is held with the magnet sheet 5, and the image-forming material is tightly attached to the magnet sheet 5 positioned on the platen surface with the smoothing roller 8. In this case, the smoothing roller 8 does not contact the tray 25, while the smoothing roller 8 is allowed to contact the image-forming material in a position near the tray 25. When the distance between the smoothing roller 8 and the tray 25 is unnecessarily large, the image-forming material is liable to float off between the sheet receiving bed 4 and the tray 25, which is liable to cause a deviation in registering due to occurrence of a crinkle, etc.

Figure 4:
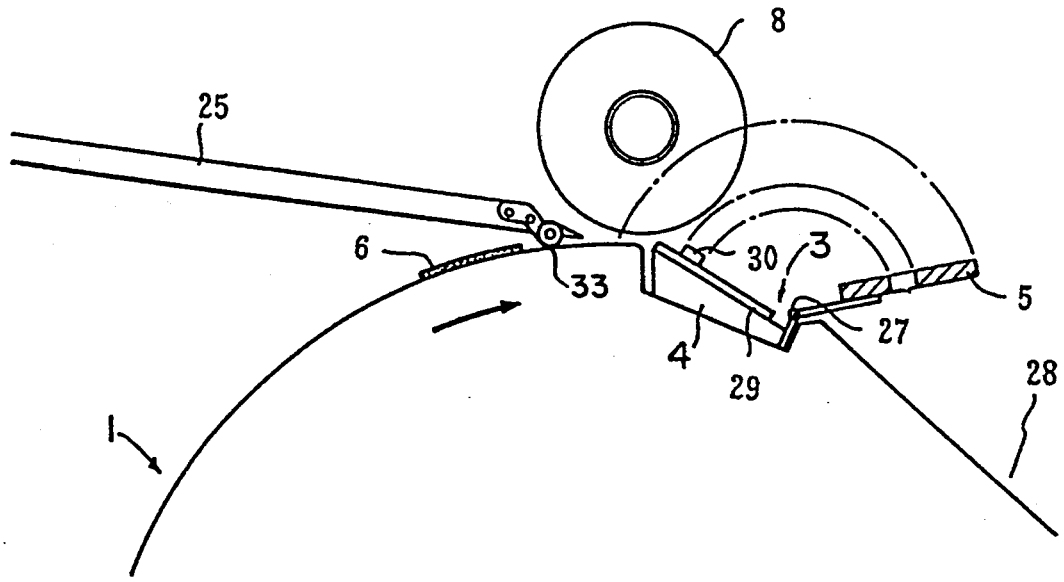
FIG. 4 is a schematic view showing a state in which the tray comes near to the platen surface.

The magnet sheet 5, which is optionally used, is to hold the image-forming material on the sheet receiving bed 4 and on part of the platen surface near the cut-out portion 3 under its own. The end portion of the magnet sheet 5 does not reach or overlap the top end portion of the tray 25. When the magnet sheet 5 is used, the sheet receiving bed 4 is formed from a material such as iron which is attracted by the magnet sheet 5, while it is not necessarily required to form the platen from such a material. When the magnet sheet 5 has proper hardness and flexibility, the image-forming material can be held not only on the sheet receiving bed but also on the platen surface due to an attracting force 4 between the magnet sheet 5 and the sheet receiving bed 4 (e.g., formed from iron). The magnet sheet 5 may be movably positioned, through a pin-joint 27, in an end portion of the partially cut-out portion 3, which end portion is farthest from the tray 25 as shown in FIG. 4.

The contact pressure between the smoothing roller 8 and the image-forming material is properly adjusted with the elastic member such as a spring, whereby the occurrence of a crinkle, etc., can be prevented.

The functions or operations of the image-transfer apparatus equipped with the smoothing roller and the image-transfer method, provided by the present invention, will be explained hereinafter.

First, the top end portion of the image-forming material is held on the sheet receiving bed of the platen with the magnet sheet 5, or the top end portion of the image-forming material is placed on the pin bar provided on the sheet receiving bed. Then, the smoothing roller 8 is moved to the guide rail 16 side by actuating the swing arm 13. The guide roller 14 provided at an end portion of the roller shaft 9 moves along the guide rail 16, and when the guide rail 16 terminates, the smoothing roller 8 comes in contact with the platen surface. The contact pressure between the smoothing roller 8 and the platen surface is adjusted with the elastic member 15.

After the smoothing roller 8 contacts the platen, the platen is rotated. With the rotation of the platen, the smoothing roller 8 rotates. The smoothing roller 8 thereby tightly attaches the image-forming material to the platen surface, while the top end portion of the image-forming material is tightly attached to the adhesive tape 6 and the bottom end portion of the image-forming material is tightly attached to the adhesive tape 6'.

The image-forming material comprises a soft material, and is therefore liable to float off. While the image-forming material is tightly attached to the platen surface with the smoothing roller 8, it is fixed with the adhesive tapes 6 and 6'. As a result, the entire area of the image-forming material is uniformly attached to the platen surface, which leads to the removal of inaccuracy in registering (positioning) which might be caused by partial floating of the image-forming material. The tray 25 preferably has rolling means such as roller(s) 33 on both sides of its top end portion for effectively preventing the tray 25 from contacting the image-forming material.

In a multi-color prepress proof, e.g., of four colors, four images are individually transferred to one image receptor. When the image-transfer apparatus of the present invention is used, image-forming materials can be easily fixed and detached, and more importantly, the image-forming materials can be attached to the platen surface with excellent accuracy in registering.

The image-transfer apparatus equipped with the smoothing roller, provided by the present invention, easily removes what have caused inaccuracy in registering such as a crinkle, slackening, etc. Further, the image-transfer apparatus equipped with the smoothing roller, provided by the present invention, permits the tight attachment of the image-forming material to the platen surface in simple operation, Furthermore, when not used, the smoothing roller is encased with the apparatus cover, which is preferred in view of workability.

What is claimed is:

1. An image-transfer apparatus which comprises a platen to which an image-forming material is to be attached and a transfer cylinder to which an image receptor is to be attached, and which allows the transfer of an image formed in a photosensitive layer of the image-forming material to the image receptor between a nip formed by the platen and the transfer cylinder, the apparatus being equipped with a smoothing roller for tightly attaching the image-forming material to the surface of the platen, the smoothing roller having a roller shaft extending from both sides of the smoothing roller and a swing arm having a shaft-movable hole through which the roller shaft is positioned, the swing arm being fitted on a swing arm shaft which is placed in a position decentered from the center of the platen and which is supported by frames of the apparatus, the smoothing roller being arranged to be drawn to the surface side of the platen through an elastic member positioned between the roller shaft and the swing arm, the smoothing roller being adapted to shift its position between a position in contact with the platen surface and a position out of contact with the platen surface due to the rotation of the swing arm.

2. An apparatus according to claim 1, wherein the smoothing roller is also provided with a guide rail for preventing the smoothing roller from moving together with rotation of the platen, the guide rail being positioned near a surface of the platen to be in contact with a guide roller provided in an end portion of the roller shaft.

3. An apparatus according to claim 1, wherein the smoothing roller is provided with a cover which is synchronized with rotation of the swing arm to open and close a movable cover provided in an end portion of a cover for the apparatus.

4. A method of transferring an image formed in a photosensitive layer of an image-forming material to an image receptor by introducing the image-forming material into a nip formed by a platen and a transfer cylinder by means of an image-transfer apparatus which has a platen to which the image-forming material is to be attached, a transfer cylinder to which the image receptor is to be attached, means of attaching the image-forming material for holding the top end and the bottom end of the image-forming material on the surface of the platen entirely in the width direction of the image-forming material, means of attaching the image receptor for holding the top end and bottom end of the image receptor on the transfer cylinder entirely in the width direction of the image receptor, a tray for introducing the image-forming material in which the image-forming material is to be placed, a tray for introducing the image receptor in which the image receptor is to be placed, and a smoothing roller for tightly attaching the image-forming material to the surface of the platen, wherein the means of attaching the image-forming material for holding the top end of the image-forming material is formed of a sheet receiving portion positioned in a partially cut-out portion formed on the surface of the platen and an adhesive tape for holding the image-forming material between the sheet receiving portion and that surface of the platen which is located near the cut-out portion, and the means of attaching the image-forming material for holding the bottom end of the image-forming material is formed of an adhesive tape provided on the surface of the platen, the method comprising tilting the tray for introducing the image-forming material in which the image-forming material is placed, to position the top portion of the tray between the sheet receiving portion and the adhesive tape located on the surface of the platen near to the sheet receiving portion, thereby placing the image-forming material in the sheet receiving portion, bringing the smoothing roller into contact with the image-forming material between the sheet receiving portion and the top portion of the tray, and rotating the platen to tightly attach the image-forming material to the surface of the platen, thereby allowing the adhesive tapes to hold the top end and bottom end of the image-forming material.

5. A method according to claim 4, wherein a pin of a pin bar provided in the sheet receiving portion is inserted in a hole made in the image-forming material when the image-forming material is placed in the sheet receiving portion.

6. A method according to claim 4, wherein the means for holding the top end portion of the image-forming material comprises a pin bar, a magnet sheet to hold the image-forming material on the pin bar and on a surface of the platen under the magnet sheet and an adhesive tape provided on a platen surface near the pin bar along a shaft direction of the platen, the tray for introducing the image-forming material is tilted to position a top portion of the tray between the adhesive tape and the magnet sheet, thereby to place the image-forming material in the sheet receiving portion, and the smoothing roller is brought into contact with the image-forming material between the magnet sheet and the top portion of the tray.

7. A method according to claim 6, wherein a pin of a pin bar provided in the sheet receiving portion is inserted in a hole made in the magnet sheet when the image-forming material is placed in the sheet receiving portion.

8. A method according to claim 4, wherein the top portion of the tray is provided with rolling means, and the rolling means is brought into contact with a surface of the platen.

* * * * *